United States Patent [19]

Sagness et al.

[11] Patent Number: 4,520,790

[45] Date of Patent: Jun. 4, 1985

[54] AIR HEATING FURNACE

[75] Inventors: Ronald L. Sagness, Bowbells; Donald A. Peterson, Berthold, both of N. Dak.

[73] Assignee: Neshem-Peterson, Inc., Berthold, N. Dak.

[21] Appl. No.: 514,084

[22] Filed: Jul. 15, 1983

[51] Int. Cl.[3] ..... F24H 3/08

[52] U.S. Cl. ..... 126/109; 126/99 D; 126/106

[58] Field of Search ..... 126/109, 104 R, 116, 126/106, 112.71, 99 R, 72, 117, 99 A, 110 R, 99 C, 110 AA, 108, 99 D; 165/DIG. 2, DIG. 13, 164; 98/45, 46; 138/38

[56] References Cited

U.S. PATENT DOCUMENTS

| | | | |
|---|---|---|---|
| 1,428,488 | 9/1922 | McNerney | 126/109 |
| 1,818,082 | 8/1931 | Mott | 126/109 |
| 2,568,487 | 9/1951 | Carswell | 126/109 |
| 2,891,535 | 6/1959 | Irey | 126/106 |
| 3,388,697 | 6/1968 | Muckelrath | 126/109 |
| 4,232,651 | 11/1980 | Lind | 126/110 E |
| 4,449,510 | 5/1984 | Sukup | 126/99 A |

*Primary Examiner*—James C. Yeung

*Attorney, Agent, or Firm*—Brisebois & Kruger

[57] ABSTRACT

Hot gases from a fuel burner in a combustion chamber are exhausted to a flue at the top of the furnace. Air to be heated is drawn into the furnace through an upper inlet, passes through a chamber around combustion gas flow tubes, and then downwardly through sidewall flow spaces along the outside of the combustion chamber. Partially heated air from the sidewall spaces flows to one end of the furnace and then through air tubes above the burner to a plenum at the other end of the furnace where the so heated air is withdrawn by a fan. The fuel can be a solid fuel such as lignite, and the heated air can be used for grain drying.

9 Claims, 5 Drawing Figures

AIR HEATING FURNACE

This invention relates generally to air heating furnaces, and particularly to such furnaces for obtaining a large volume of heated air from a relatively small size furnace with high efficiency heat transfer. While the invention has general utility in any field where it is desired to heat large quantities of air, this furnace finds particular utility in heating air for grain drying, using solid fuel.

BACKGROUND OF THE INVENTION

At present, propane or lpg is used for drying grain such as wheat, and other agricultural products such as cotton. An advantage of using propane or similar liquid or gaseous fuel which burns clean is that the products of combustion are directly used for grain drying by passing these combustion products through the grain or other comodity. A relatively simple burner system can be used with such fuels, and the control of heat output is easy to regulate simply by regulating the flow of fuel to the burners.

However, in recent years, the price of such fuels has increased significantly, with the result that the cost of grain drying or cotton drying has increased significantly, and the cost is particularly high in regions of the country somewhat removed from wells which produce such gas. Further, the products of combustion of such clean burning fuels form water as a principal exhaust component, and correspondingly, the combustion products have a relatively high moisture content. As a result, some of the heat generated by burning the fuel is lost because this heat is required to remove the moisture added by the products of combustion.

Large quantities of hot air are also required for other uses such as factory heating, and industrial processes requiring heated air.

Correspondingly, there is a need for a heater or furnace for providing large quantities of hot air, particularly by burning a solid fuel such as coal, or lignite, or similar products, as well as very low grade solid fuels such as wood pellets, corn cobs, distressed corn, or sunflower hulls, and which can also be used to burn liquid or gaseous fuels should the price of such fuels be competitive, or desireable.

SUMMARY OF THE INVENTION

Applicant's invention relates to a high efficiency furnace or heater for efficiently heating large quantities of air, and which can burn low grade solid fuel. A distinct advantage of Applicant's invention is that the air flow path of the air which is heated includes most of the usually exposed exterior surfaces of the furnace so that the exterior conduction losses of heat are maintained at a minimum, and most exposed surfaces of the furnace remain at a relatively low temperature, below the temperature at which personnel or livestock would be injured so that exterior insulation, or a safety enclosure or protective wall is not required.

By virtue of this air flow path, much heat usually lost by conduction through the furnace walls is conserved, which enhances the efficiency of the furnace of this invention.

In accordance with the invention, air flow is induced by a fan and includes a counter-current tortuous path wherein the air is drawn in from the top of the furnace, and flows downwardly over sets of fire tubes through which hot combustion gases flow to the flue or chimney. The air is then drawn through hollow sidewalls of the furnace in which the air is conducted along the combustion chamber sidewalls to a plenum at one end of the furnace from which the air flows through air tubes above the furnace burner to the opposite end of the furnace, and from which the air can be drawn downwardly and then directed to the region of use.

In accordance with the invention, each of the air tubes advantageously has internal flow directors or turbulence inducers to cause the air flowing through the tubes to move in a generally helical pattern, these flow directors advantageously being in direct contact with the inner surface of the tubes to enhance heat transfer by conduction.

In accordance with another aspect of this invention, flow directors are provided in the outer walls of the furnace to direct the air along the entire surface of these walls, these flow directors being of metal to further enhance heat transfer by conduction.

Hot combustion gas from the burner flows upwardly, first around the air tubes, then through the combustion gas tubes which have inlets at opposite ends of the furnace, to the flue or chimney. Further, some combustion gas flows directly to the flue through smaller openings located generally in the center of the furnace. This arrangement assures maximum heat transfer without danger of undesired back pressure or choking in the combustion chamber.

The gas tubes through which the combustion gases flow enroute to the flue are also provided with turbulence inducing means to cause the gases to move in a helical path from the inlet to the outlet of each tube. Because of the high fly ash content of poor grades of fuel that can be burned in the furnace, the turbulence inducing means advantageously take the form of helical auger-like elements which are mounted to be rotated to permit cleaning fly ash from the tubes by rotating these elements. The auger elements, when rotated, move accumulated fly ash toward the inlet ends of the tubes which are directly above the combustion chamber so that discharged ash falls to the combustion chamber floor from which the ash can be removed with the solid fuel ashes.

Advantageously, where solid fuel is burned, the furnace includes an appropriate burner or fire box which is fed by a stoker, and the resulting ash can be removed either manually, or with any known form of ash removal arrangement, such as an ash removal auger. When the furnace is used for grain drying, there will normally be an operator who periodically checks the operation of the furnace, and this operator can readily remove accumulated ashes from the furnace through an ash removal door provided for this purpose.

While a preferred embodiment of the furnace of this invention will be described in detail, in connection with the accompanying drawings, it is to be understood that this preferred embodiment is simply a representative example of the invention without limiting effect.

DETAILED DESCRIPTION

Figure 1:
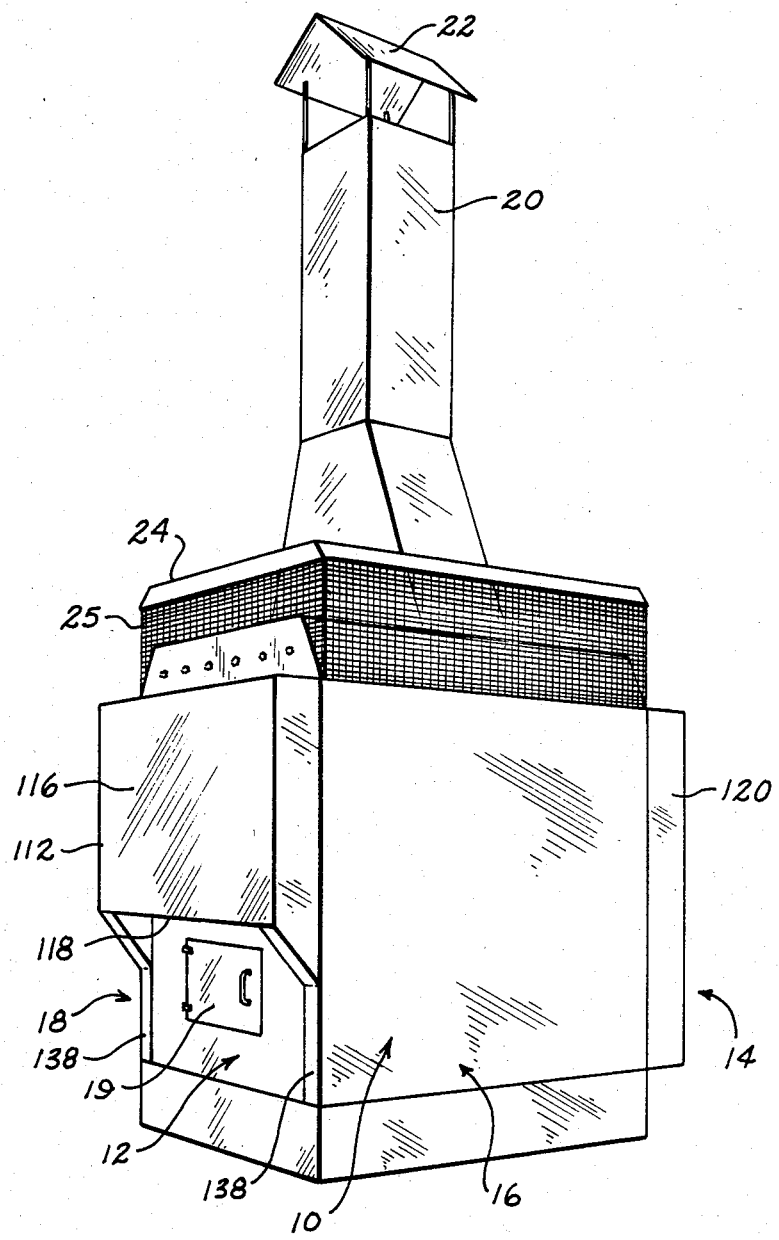
FIG. 1 is a pictorial view of an air heating furnace in accordance with the invention.

Referring now to the drawings, particularly FIG. 1, there is shown a grain dryer furnace in accordance with the invention. Furnace 10 is generally rectangular, with the body of the furnace fabricated, as by welding, from iron or steel plate.

As shown in the drawings, the furnace includes a front 12, a rear 14, and sides 16 and 18. There is a door 19 at the front to permit inspection, provide access to the interior of the furnace, and for ash removal when solid fuel is used.

At the top of the furnace is a generally centrally located chimney or flue 20 provided with a cap 22 to prevent rain water from entering the flue.

A sheet metal cover 24 is located slightly above the top of the furnace and extends around the flue. An air inlet grill 25 in the form of a coarse screen extends between cover 24 and the furnace to prevent birds and other large objects from entering air inlet openings located in the top of the furnace within the grill. The cover 24 also serves as a shield to minimize the entry of rain water into the furnace through the air inlet openings.

Figure 2:
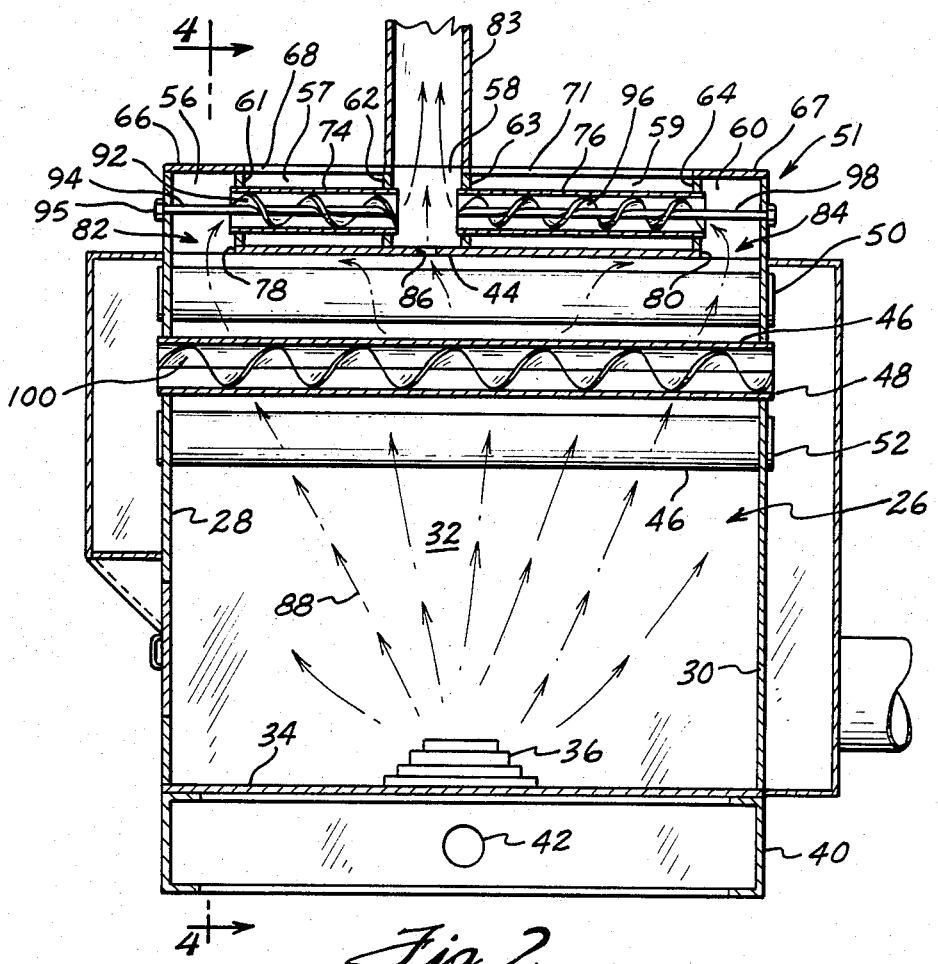
FIG. 2 is a view in section taken along line 2—2 of FIG. 4, and shows the combustion gas flow path.
Figure 3:
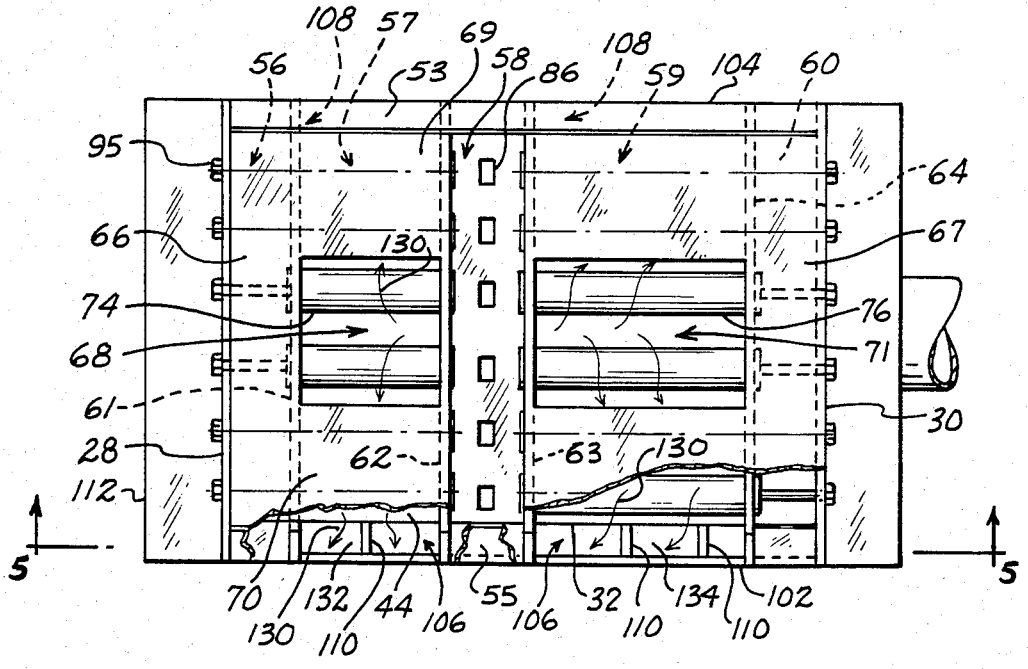
FIG. 3 is a top plan view of the furnace with the chimney removed and portions cut away for purposes of illustration.
Figure 4:
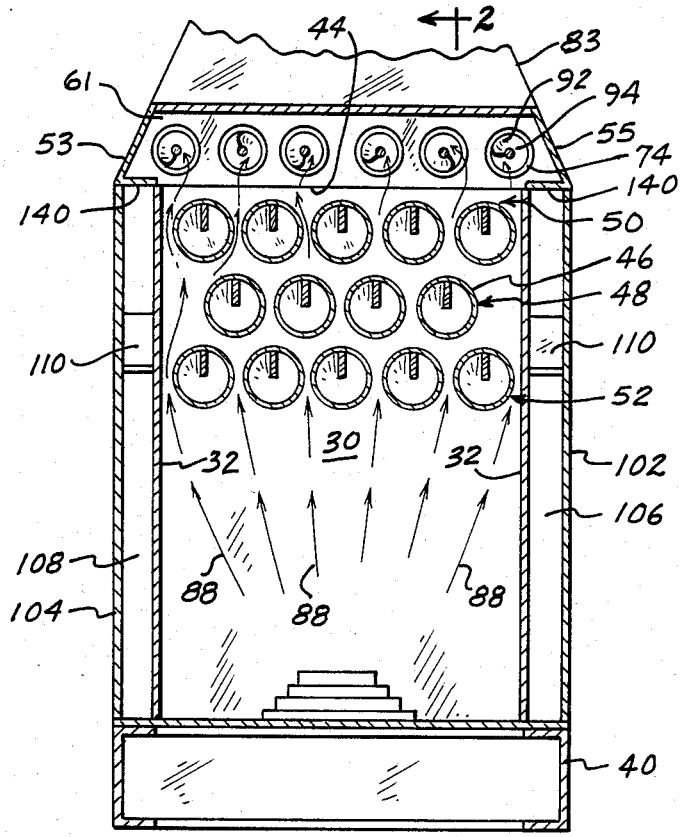
FIG. 4 is a view in section taken along line 4—4 of FIG. 2, and shows a portion of the combustion gas flow path.

As shown at FIGS. 2–4, the furnace has a combustion chamber 26 with a front wall 28, a rear wall 30, and side walls 32. A bottom wall 34 supports a burner 36.

Below bottom wall 34 is a base 40 which forms a rectangular enclosure and spaces bottom wall 34 of the combustion chamber from the ground or other support surface on which the furnace is mounted.

Base 40 provides a housing to accomodate a stoker 42 (shown schematically) to supply solid fuel to the burner 36, when the furnace is solid fuel fired. A fan or blower to supply combustion air to burner 36 can also be located in base 40. While the burner 36 has been shown as a solid fuel burner, the burner can be a liquid or gaseous fuel burner if it is desired to use such fuels.

Between burner 36 and a top wall 44 of the combustion chamber are three horizontal rows of parallel air flow tubes 46. Each air flow tube 46 extends horizontally through the combustion chamber and the ends of each tube extend through close fitting openings in the respective front wall 28 and rear wall 30. The air flow tubes are circumferentially welded in these openings in the front and rear walls, so that the interior of each tube is isolated with respect to combustion gases in the combustion chamber 26. As is evident from FIGS. 2 and 4, there are three horizontal rows of parallel spaced apart air flow tubes 46, with the tubes in the intermediate row 48 disposed in the spaces between the tubes of the upper and lower rows 50 and 52.

The region 51 of the furnace above top wall 44 of the combustion chamber has sloping side plates 53 and 55 which extend between front wall 28 and rear wall 30 and are welded to beveled ends of these walls. This top region 51, is divided into a plurality of compartments or chambers 56–60 by trapezoidal shaped vertical plates 61–64 which extend the width of the furnace between sideplates 53 and 55, and have beveled ends welded to the respective side plates.

The bottom edge of each of the vertical plates 61–64 is welded along its length to top wall 44 of the combustion chamber.

The top of chamber 56 is closed by a top plate 66 which extends the length of the chamber and is welded to side plates 53 and 55 and along the top edges of front wall 28 and vertical partition 61. The top of chamber 60 is similarly closed by a top plate 67. The portions of the top of chamber 57 on opposite sides of a centrally located air inlet opening 68 are closed by top plates 69 and 70. An air inlet opening 71 is also provided centrally of chamber 59.

At the top of the furnace are two rows of combustion gas flow tubes 74 and 76. Each row of tubes is composed of a plurality of horizontally extending spaced-apart tubes. The ends of tubes 74 extend into openings in the respective vertical plates 61 and 62, in which the tubes are circumferentially welded. Tubes 76 are also welded in the openings of the vertical plates 63 and 64 into which the ends of these tubes extend.

The top wall 44 of the combustion chamber has its front edge 78 spaced from front wall 28 and its rear edge 80 is spaced from rear wall 30 to provide substantially unobstructed openings 82 and 84 between the combustion chamber and the respective compartments 56 and 60.

By virtue of this arrangement, hot combustion gases flow from the combustion chamber through the openings 82 and 84 into the respective compartments 56 and 60, and then flow horizontally through the tubes 74 and 76 to outlet chamber 58. Outlet chamber 58 has a rectangular top opening between vertical plates 62 and 63 and side plates 53 and 55. Seated on this top opening is a chimney flue pipe 83 which directs the combustion gases to the flue.

The top wall 44 of the combustion chamber in the region of combustion gas outlet chamber 58 has a plurality of small generally rectangular openings 86 which permit the flow of some combustion gases from the combustion chamber directly into the outlet chamber 58. These openings are provided to prevent choking in the combustion chamber.

The combustion gas flow path is shown by the dot-dash arrows 88 in FIGS. 2 and 4. As is evident, the combustion gases from burner 36 flow upwardly in combustion chamber 32, around the outsides of air flow tubes 46, then through openings 82 and 84 at opposite ends of the furnace, then horizontally through the insides of the respective combustion gas flow tubes 74 and 76 to outlet chamber 58 and then to flue pipe 83. Further, a relatively small portion of the combustion gases flow directly through openings 86 into outlet chamber 58, to flue pipe 83.

Within each combustion gas flow tube 74 is a turbulence inducer in the form of a helical element 92 secured to a central shaft 94. The helical element 92 extends the length of gas flow tube 74, and shaft 94 extends through front wall 28. Secured to the end of shaft 94 which is outside the wall 28 is a nut or similar tool engagable element 95, which permits rotating the shaft 94 and the helical element 92 fixed to the shaft. The helical element 92 is a relatively close rotational fit within tube 74 so that rotating shaft 94 causes fly ash or similar material such as soot to be augered and moved toward chamber 56, to clear such fly ash and soot from the interior of tube 74. Such soot or fly ash is then free to fall downwardly into the combustion chamber onto wall 34. Further, the helical element 92 imparts a swirling action to the exhaust gases passing through tube 74 to enhance heat transfer through the wall of the tube 74.

Each tube 76 also has a helical auger element 96 fixed to a shaft 98. The element 96 performs the same function as the element 92, and fly ash can be augered from the inside of tube 76 by rotating the respective shafts 98.

As shown at FIGS. 2 and 4, a helical turbulence inducer 100 is located within and extends the length of each air flow tube 46. The turbulence inducer is a close fit in and engages the inside surface of tube 46 to provide some heat transfer by conduction through the wall of each tube 46. The turbulence inducers 100 enhance heat transfer between the hot combustion gases which flow around the exterior of tubes 46 and the air which is heated, which flows through the interiors of these tubes.

As shown at FIGS. 3 and 4, there are outer walls 102 and 104 in spaced relation to the respective side walls 32 of the combustion chamber, to define air flow spaces 106 and 108 between these walls at each side of the furnace. Each side wall air flow space has a length and height the same as a side wall 32, and a width equalt to the spacing between the side wall 32 and its outer wall 102 or 104.

Within the air flow spaces 106 and 108, are sheet metal air flow deflectors 110 (FIG. 5) which function to direct the flow of air through the side wall spaces across a major portion of the outside surface of combustion chamber walls 32. Each deflector 110 is welded to side wall 32 to provide heat conduction between the side wall 32 and the deflector. These deflectors 110 extend the width of the side wall air space to cause air flowing through the air space to be directed downwardly and then forwardly along the outside of each side wall 32.

At the front of the furnace is a fabricated plenum 112 which has a height less than the height of the furnace but more than one-half the height of the furnace. This plenum extends across the front of the furnace from outer wall 102 to outer wall 104. At its opposite sides, plenum 112 communicates with the air spaces 106 and 108, so that air which is heated and flows through each of the side wall air spaces reaches the inlet ends 114 of air flow tubes 46.

Figure 5:
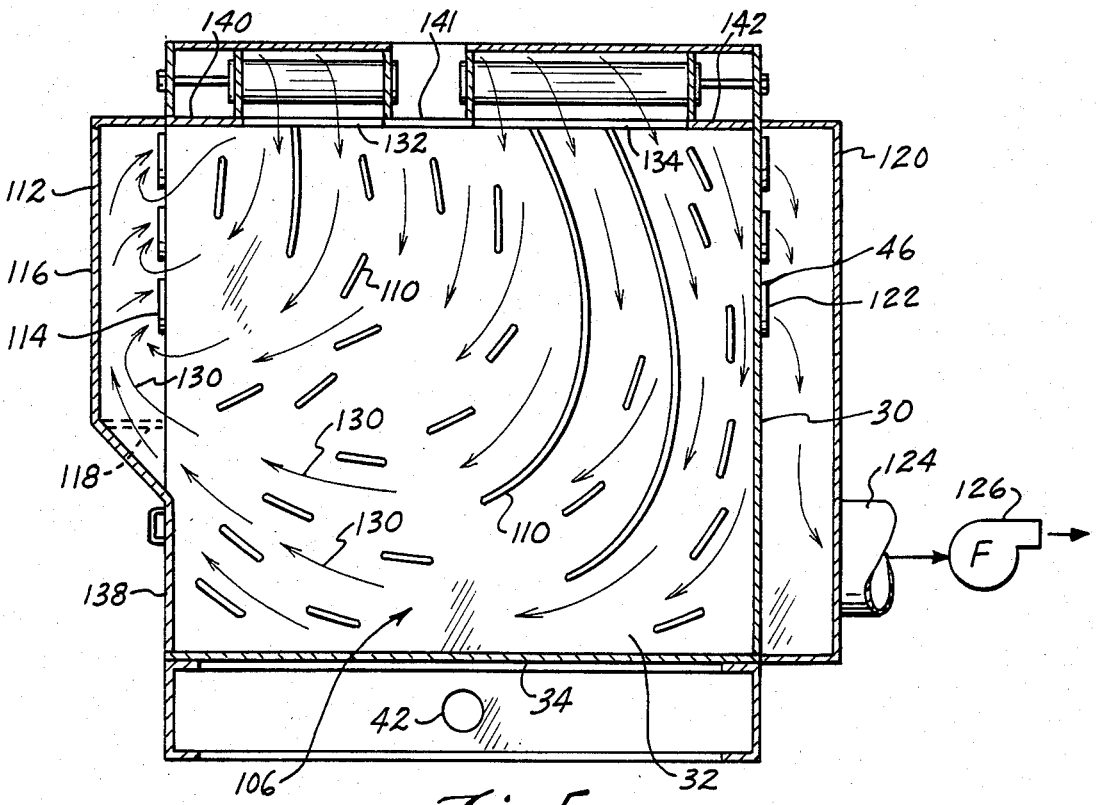
FIG. 5 is a view in section taken along line 5—5, and shows the flow path of the air which is heated.

As shown at FIGS. 1, 2, and 5, the central portion 116 of plenum 112, which communicates with the inlets 114 of tubes 46 has a bottom wall 118 which is located above the door 19 of the furnace.

At the rear of the furnace is a box-shaped plenum 120 which receives the air which is heated from the outlet ends 122 of the air flow tubes 46. Communicating with plenum 120 is a discharge pipe 124 connected to a suction fan 126 which draws the air to be heated through various air flow passages of the furnace, and directs the heated air to apparatus requiring such air, such as a grain dryer.

The flow path of the air which is heated by the furnace is shown by solid line arrows 130 in FIGS. 3 and 5. As a result of action of the fan 126, air is drawn through the respective inlets 68 and 71 in the respective chambers 57 and 59 in the top of the furnace. The air flowing through these inlets divides and flows laterally outwardly toward the respective side wall air flow spaces 106 and 108. During flow through the chambers 57 and 59, the air flows around the outside of the respective tubes 74 and 76 to transfer some heat to this air. Then, the air flows downwardly through side wall inlets 132 and 134 at the respective ends of the chambers 57 and 59. The air then follows the downward, forward, and upward path through the side wall air spaces shown by the arrows 130, to enter plenum 112, at the sides of this plenum. In the plenum, the air flows inwardly and into the inlets 114 of the air flow tubes 46. The air then flows through the tubes 46 to plenum 120 from which it is withdrawn by fan 126.

It is to be appreciated that the only air inlets to the respective side wall air spaces 106 and 108, are the respective inlets 132 and 134 at the opposite ends of the respective chambers 57 and 59. As shown for side wall air flow space 106, at FIG. 5, the rear of the space is closed by rear wall 30 of the combustion chamber which extends to the outer walls 102 and 104, and is closed at its bottom by bottom wall 34 of the combustion chamber, to which the bottom edges of the outer walls are welded.

At the front of the furnace, filler plates 138 close the lower portions of the side wall air flow spaces below plenum 112. Further, at the top of the furnace, filler plates 140, 141, and 142 isolate the chambers 56, 58, and 60 from the side wall air flow spaces. By virtue of this arrangement, the air which is heated does not co-mingle with the combustion gases from the burner.

In an embodiment of the furnace described, which is approximately ten feet long, six feet wide, and approximately ten feet high, excluding the flue pipe and chimney, air flowing through the air flow system at a flow rate of 17,500 cfm was heated 105° in temperature so that the air flowing from outlet pipe 124 had a temperature of 210° F. based on other known air heating furnaces, particularly those using solid fuel, this is a very significant usable heat output from a furnace of this size.

It is to be appreciated that liquid or gaseous fuels can be used to heat the furnace, if desired.

Further, while a particular number of air flow tubes as well as combustion gas flow tubes have been shown and described, it is to be appreciated that the number of these tubes as well as the number of rows of these tubes can be varied to suit the needs of a particular furnace.

While a preferred embodiment has been shown and described, numerous changes can be made without departing from the scope of this invention.

We claim:

1. An air heating furnace comprising a combustion chamber including a first end wall, a second end wall, and spaced apart sidewalls connected to said end walls, burner means in said combustion chamber for burning fuel to create hot combustion gases, flue means at a top portion of the furnace for exhausting combustion gases from the furnace, a plurality of spaced-apart air flow conduits above said burner means and extending across said combustion chamber between said end walls, outside surface of said air flow conduits being in the path of travel of combustion gases from the burner means to the flue means, a plurality of spaced-apart generally horizontal combustion gas flow conduits between the flue means and said combustion chamber, said combustion gas flow conduits having inlets communicating with said combustion chamber for receiving combustion gases and outlets communicating with the flue means, chamber means for isolating the exterior of the combustion gas flow tubes with respect to their inlets and outlets, said chamber means having an inlet for air to be heated and including means for directing air entering the inlet around the exterior of the combustion gas flow tubes to outlets at opposite sides of the chamber means, outer wall means in spaced relation to the outside surface of each side wall of the combustion chamber, said outer wall means combining with said side walls to provide sidewall air flow spaces, means in said side wall air flow spaces between said outer wall means and said combustion chamber walls to direct air from said chamber means downwardly and toward said first end of the furnace, plenum means at said first end of the furnace for receiving air from said side wall air flow spaces and for directing the air through said air flow conduits, plenum means at said second end of the furnace for receiving air from the air flow conduits, and fan means for forcing air to be heated through the air flow passages of the furnace.

2. A furnace according to claim 1 wherein said air flow conduits further comprise turbulence inducing means within said air flow conduits for enhancing heat transfer between combustion gases flowing around said conduits and air to be heated flowing through the conduits.

3. A furnace according to claim 2 wherein said turbulence inducing means comprises means for directing air flowing through said conduits in a helical path.

4. A furnace according to claim 3 wherein said turbulence inducing means comprise helical fins within said conduits, said fins engaging the interior surface of the conduits to enhance heat transfer.

5. A furnace according to claim 1 wherein said combustion gas flow tubes comprise turbulence inducing means therein to enhance heat transfer between combustion gases flowing through the tubes and air to be heated flowing through said chamber means and across the outsides of the tubes.

6. A furnace according to claim 5, wherein said turbulence inducing means comprise helical elements within each combustion gas flow tube.

7. A furnace according to claim 6, wherein each helical element comprises an auger fixed to a shaft, and means accessible from the outside of the furnace for rotating said augers to clean the interiors of said combustion gas flow tubes.

8. An air heating furnace according to claim 1 wherein said plurality of combustion gas flow tubes comprise a first set of horizontal tubes having inlets adjacent said first end wall, a second set of combustion gas flow tubes having inlets adjacent said second end wall, said combustion gas flow tubes having outlets communicating with a common outlet chamber located generally centrally of the furnace, and said flue means extends across said outlet chamber.

9. A furnace according to claim 8 further comprising a combustion chamber top wall having openings communicating with said outlet chamber for permitting the flow of some combustion gases from the combustion chamber directly to the outlet chamber.

* * * * *